United States Patent [19]

Shanaan et al.

[11] Patent Number: 4,607,510

[45] Date of Patent: Aug. 26, 1986

[54] LOCK MECHANISM FOR CLOSURE MEMBERS

[75] Inventors: Gad Shanaan; Jack Jospé; Joe Jospé, all of Montreal; Carlo Caputo, La Salle, all of Canada

[73] Assignee: Ideal Security Inc., Quebec, Canada

[21] Appl. No.: 657,257

[22] Filed: Oct. 3, 1984

[51] Int. Cl.[4] ..... E05B 65/08

[52] U.S. Cl. ..... 70/95; 292/98; 292/140; 292/DIG. 46

[58] Field of Search ..... 70/95, 99, 100; 292/98, 292/100, 132, 140, 143, 147, 152, 187, DIG. 7, DIG. 20, DIG. 46, DIG. 57

[56] References Cited

U.S. PATENT DOCUMENTS

| | | | |
|---|---|---|---|
| 3,026,702 | 3/1962 | Cary | 292/DIG. 46 |
| 3,213,652 | 10/1965 | Tucker | 292/DIG. 46 |
| 3,390,557 | 7/1968 | Erickson | 292/152 |
| 4,024,739 | 5/1977 | Kaufman | 292/DIG. 46 |

FOREIGN PATENT DOCUMENTS

| | | | |
|---|---|---|---|
| 59147 | 7/1977 | Australia | 292/DIG. 46 |
| 1396876 | 6/1975 | United Kingdom | 292/DIG. 46 |

*Primary Examiner*—Robert L. Wolfe

*Attorney, Agent, or Firm*—Burns, Doane, Swecker & Mathis

[57] ABSTRACT

A lock mechanism for a closure member, such as a sliding door. The mechanism comprises a housing for securement to the sliding door. A locking slide member is slidingly guided in the housing. The slide member has a locking element to engage and disengage with a keeper member secured to the frame of a door opening adjacent the sliding door. A slide activating rotating knob is rotatably retained in the housing for limited rotating displacement therein. A slide displacing pin is secured to the rotating knob and offset from the central rotating axis of the knob. The slide member has a pin receiving slot which coacts with the pin whereby limited rotation of the knob causes displacement of the pin to frictionally engage the slide in the slot to cause limited sliding displacement of the slide between a locked and unlocked position. The pin and the slide also coact, when in the locked position, whereby to provide positive interlocking to prevent displacement of the slide by force applied thereto.

13 Claims, 8 Drawing Figures

LOCK MECHANISM FOR CLOSURE MEMBERS

BACKGROUND OF INVENTION (a) Field of the Invention

The present invention relates to a lock mechanism for use on closure members, such as a sliding door, and more particularly to an improved latch type lock mechanism providing visual display of the position of the lock and further providing positive locking to prevent disengagement of the lock, by exterior forces on the lock slide plate, when in the locked position.

(b) Description of Prior Art

Door lock mechanisms of the latch type, to which the present invention relates, are known, such as disclosed in Canadian Pat. No. 963,505 issued on Feb. 25, 1975. That patent is concerned with a door latch assembly for use on sliding doors and providing visual display of the position of the lock, whether in a locked or an unlocked position. Such visual display is provided by displaying one of two color indicias, indicative of the position of the lock, by sliding a lock activating member which covers one of them. A disadvantage of such a lock is that these indicias wear out quickly or become unglued when they are provided as a colored glue tab, and are very small and difficult to see from far away.

Also, such door latch mechanisms, employing sliding locking members, have a disadvantage in that such members can become unlocked by applying a pressure to the door frame along the long axis of the slide locking plate member or otherwise applying a force thereto to displace the slide to cause the lock to become disengaged. Therefore, there exists a need to make sure that such slide locking plate member is positively engaged by the lock mechanism and cannot be unlocked by applying a force thereto along the long axis of the slide member.

SUMMARY OF INVENTION

It is a feature of the present invention to provide an improved locking mechanism for closure members, such as sliding doors, and which substantially overcomes all of the above-mentioned disadvantages of the prior art.

It is a further feature of the present invention to provide an improved lock mechanism for a closure member, such as a sliding door, and wherein the inside handle member of the lock mechanism is provided with a position indicator whereby to indicate if the lock is in a locked or unlocked position, which indicator is visible from far away.

Another feature of the present invention is to provide an improved lock mechanism for a closure member, such as a sliding door, and wherein there is provided a locking slide member having arresting means to prevent movement of the slide member, by a force applied thereto, when located in a locked position.

According to the above features, from a broad aspect, the present invention provides a lock mechanism for closure member. The mechanism comprises a housing for securement to one side of the closure member. A locking slide member is slidingly guided in the housing. The slide member has a locking element to engage and disengage with a keeper member secured to a further member adjacent the closure member. A slide activating rotating knob is rotatably retained in the housing for limited rotating displacement therein. A slide displacing pin is secured to a body of the rotating knob and offset from the central rotating axis of the knob. The slide member has a pin receiving slot coacting with the pin whereby limited rotation of the knob causes displacement of the pin to frictionally engage the slide in the slot to cause limited sliding displacement of the slide between a locked and an unlocked position. Arresting means is also provided to prevent movement of the slide by applying a force thereto when the slide is in its locked position.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 6:
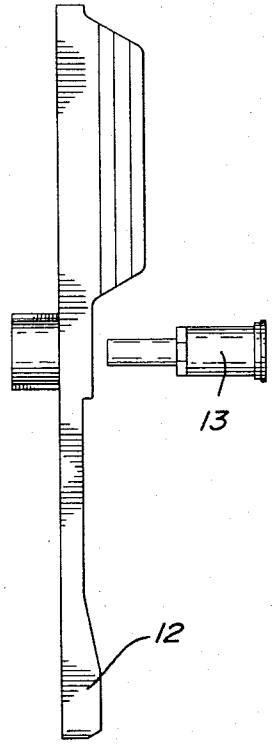
FIG. 6 is a partly exploded side view showing the construction of an outside portion of the lock handle member.
Figure 5:
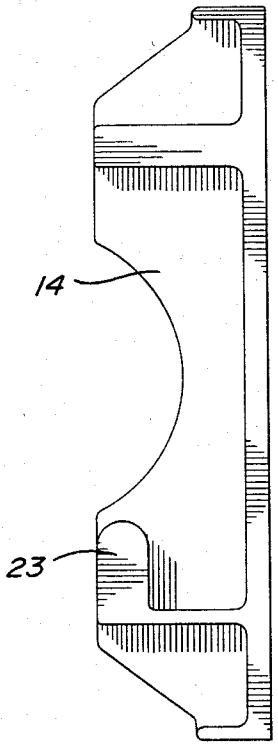
FIG. 5 is a side view of FIG. 4.
Figure 4:
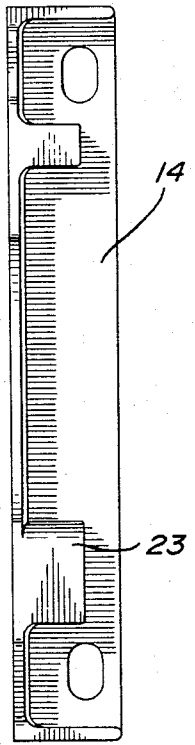
FIG. 4 is a plan view of the keeper member.

The lock mechanism 10 of the present invention comprises a housing 11 which constitutes an inside handle member portion, incorporating a handle 11', and adapted for securement to a side frame of a closure member (not shown), such as a sliding door. The housing 11 is usually secured to the frame of a sliding door facing inside a closure. An outside portion of the lock is also provided with a handle housing 12 (see FIG. 6) also having a handle 12' and is secured to the outside of the frame of the sliding door in alignment with the inside housing 11. A key-operated lock mechanism 13 is provided in housing 12 whereby to activate the lock mechanism from the outside to displace it to a locked or unlocked position. A keeper member 14, as shown in FIGS. 4 and 5, is secured to a door frame (not shown) adjacent the lock mechanism 10 and is engaged and disengaged by a sliding lock plate of the lock as will be described later. Such described latch type lock is standard and well known in the art.

Figures 1, 2, 3A, 3B:
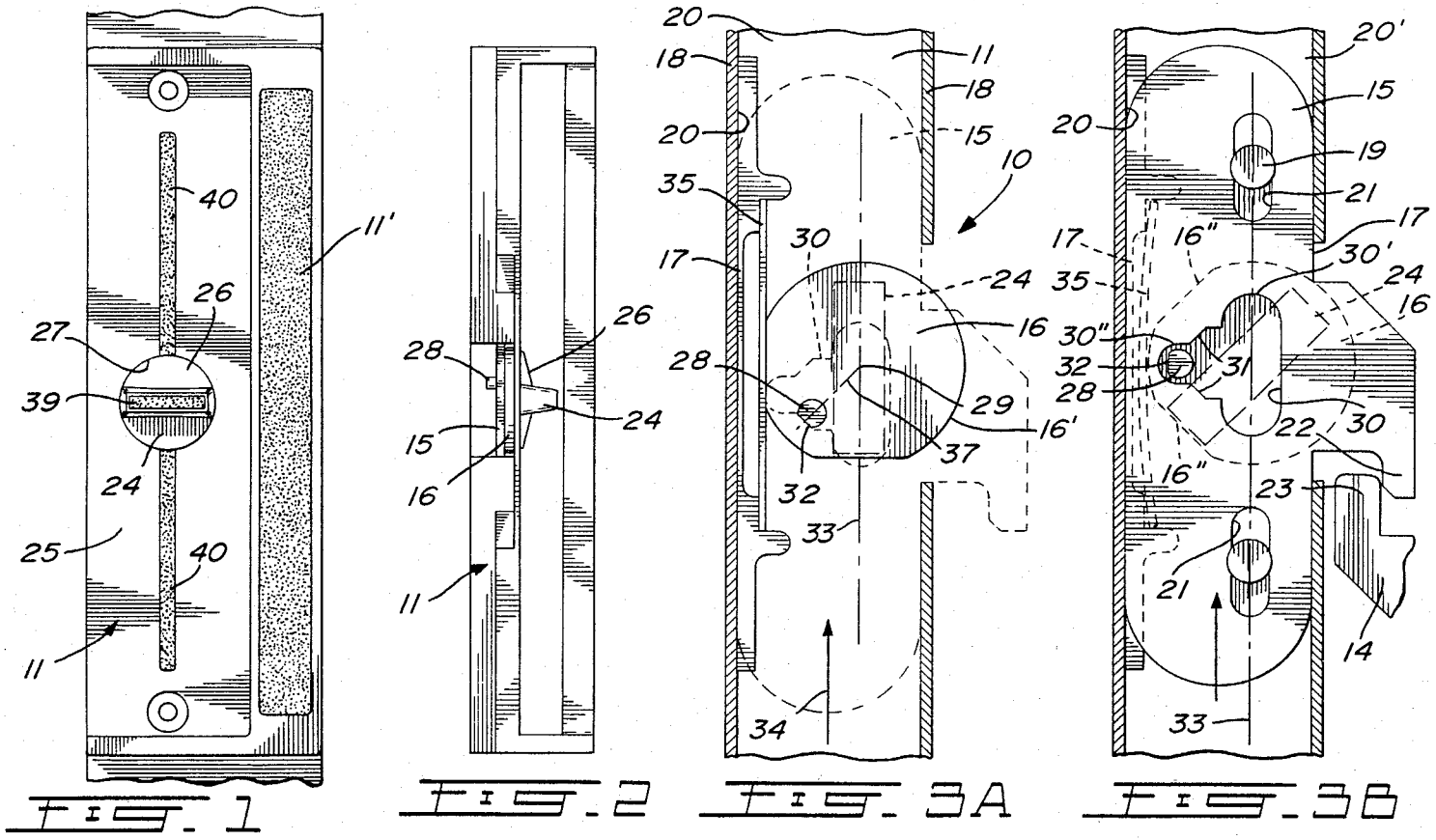
FIG. 1 is a front view of the inside portion of the lock handle member which houses the lock mechanism of the present invention.
FIG. 2 is a side section view of FIG. 1.
FIGS. 3A, 3B and 3C are rear views of the housing shown in FIG. 1 illustrating the lock mechanism of the present invention in its various positions from a locked to an unlocked position.
Figure 3:
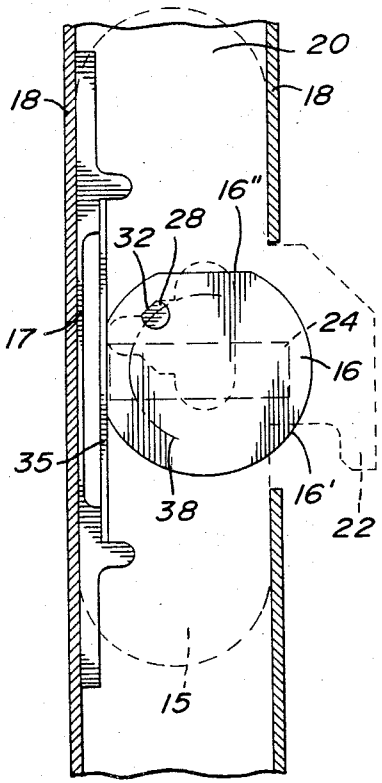

Referring now more specifically to the latch of the present invention as illustrated in FIGS. 1 to 3, the lock mechanism 10 is comprised of a slide plate member 15 which is slidingly guided in the housing 11 and displaceable between a locked position, as shown in FIGS. 3A and 4, to an unlocked position, as shown in FIG. 3C. The locking slide member 15, as shown in FIG. 3B, is provided as an elongated flat plate having opposed parallel side edges 17 slidingly guided in an elongated channel 20 defined by opposed parallel guide walls 18. The locking slide member 15 is retained captive in the channel 20 by means of at least one stop pin 19, herein two, which are secured to the bottom wall 20' of the channel 20 and protrudes through a respective guide slot 21 provided in the locking slide member 15. The guide slot 21 is of a predetermined length to permit sliding displacement of the slide member 15 from a locked to an unlocked position and the free end of the stop pin 19 is flared out at 22 to prevent disengagement of the slide member 15 with the pin 19.

The slide member 15 is also provided with a lock finger 22 intergrally formed therewith and displaceable from a locked position (FIG. 3A) to an unlocked position (FIG. 3C), whereby to engage and disengage behind a retaining wall or protrusion 23 in the keeper member 14, as shown in FIGS. 4 and 5, and which is secured to a side wall of a door frame (not shown).

The slide member 15 is displaceable in the channel 20 by a slide activating rotating knob 24 secured in the housing 11 and located on the inside face 25 of the housing disposed on the inside wall of a closure. The rotating knob 24 has a circular shaft portion 26 which is retained in close fit within a circular cavity 27 and rotatable therein along a limited arc. The back side of the circular body 26 is provided with a cam 16 having a slide displacing pin 28 secured thereto and positioned offset from the central pivot axis 29 of the circular body.

The slide member 15 is provided with a pin receiving slot 30 having an elongated axial opening 30' and a transverse opening 30'' extending transverse to one side of the long axis 33 of the slide whereby to receive therein the slide displacing pin 28 so that limited rotation of the knob causes displacement of the pin 28 along an arc 38 (see FIGS. 3A–3C) whereby the pin frictionally engages opposed parallel side walls of the transverse opening 30'' of the slot 30 to displace the slide along its longitudinal axis 33 whereby to place it in a locked or unlocked position. Each side wall of the transverse opening 30'' is also provided with an angulated abutment wall 31 onto which rests a flat abutment face 32 of the pin 28 when the knob 24 is in its locked or unlocked position. The cam 16 has a circular peripheral wall 16' having two flat sections 16'', disposed 90° apart, onto which rests a straight leaf spring 35 when the cam 16 is at the locked or unlocked position to maintain the knob in position by applying a pressure to the cam when rotated.

FIG. 3A illustrates the position of the locking pin 28 with respect to the pin receiving slot 30 when the knob 24 is in its locked position, that is to say, disposed vertically. The pin 28 and the slot 30, when in the locked position, engage each other along abutting faces 31 and 32 to constitute an arresting means whereby to prevent any forced movement of the slide 15 along its long axis, and namely in the unlocking direction as illustrated by arrow 34. This arresting means is constituted by disposing the abutment wall 31 on a 45° angle in the side walls of the transverse opening 30'' whereby any force applied to the slide 15 in the direction of arrow 34 will result in a vector force being applied along the axis 37 which passes through the central pivot axis 29 of the knob 24. This results in an increase in pressure between the angulated abutment face 32 and the angulated notch 31 thus increasing the locking force between these faces and further resistance against displacement of the slide 15 by a force applied directly thereto. The axis 37 of the resulting force further prevents the knob 24 from rotating as it becomes more secure with this added pressure.

By displacing the knob and the locking pin 28 along the arc 38 by rotation of the knob 24 in the direction shown in FIGS. 3B and 3C, the abutment face 32 is easily disengaged with the abutment wall 31 and the pin 28 will then engage the upper edge of the slot transverse opening 30'' and push the slide 15 upwardly along the direction of arrow 34 to unlock the slide. Also, as the knob 24 is turned, the cam pushes against the spring 35 to apply a frictional force whereby the knob is maintained arrested at the desired position and not freely rotatable whereby to accidentally be displaced to the locked position when unlocked. Also, it can be seen that as the cam is moved past its mid position, a shown in FIG. 3B, the spring action will displace the cam and knob flat sections 16'' will come to rest on the spring 35 freely supported in position at its opposed ends on a plateau support 35'. The slide 15 is positioned over the spring 35 and keeps it in place.

Referring now more specifically to FIG. 1, there is illustrated the construction of the indicating means whereby to indicate if the locking mechanism is in a locked or unlocked position. The indicating means consists of a straight indicator bar 39 provided by a material strip or paint strip of contrasting color extending diametrically across the knob 24 and disposed vertically when the lock mechanism is in a locked position and displaced to a horizontal position when in the open position. On the front or inside surface 25 of the housing 11 there is also provided elongated aligned straight bar sections 40 disposed on the vertical or long axis of the housing 11 on a respective side of the rotating knob 24. When the knob is rotated to the lock position, the straight bar 39 on the knob becomes aligned with the straight bar sections 40 thus providing a visual indication that the locking mechanism is in its locked position, such visual indication being visible from very far away.

The rotational displacement of the knob 24 is restricted to one-quarter turn by selecting the proper length of the guide slots 21 in the slide member or by the mating engagement between the cam flat sections 16'' and the spring 35. The rotational displacement of the knob may also be provided by other means associated with the circular knob whereby the knob could abut a stop member (not shown) secured to the housing.

It is within the ambit of the present invention to cover any obvious modifications provided they fall within the scope of the appended claims. It is also pointed out that the closure member need not necessarily be a sliding door, as the lock mechanism could be secured to sliding window panes with the housing being secured to a window sash (not shown) and the keeper member secured to a window frame (not shown) adjacent the housing. Also, the shape of the housings with the handle members may be differently designed.

We claim:

1. A lock mechanism for a closure member, said mechanism comprising a housing for securement to one side of said closure member, a locking slide member slidingly guided in said housing, said slide member having a locking element to engage and disengage with a keeper member secured to a further member adjacent said closure member, a slide activating rotating knob rotatably retained in said housing for limited rotating displacement therein, a slide displacing pin secured to said rotating knob and offset from a central axis thereof, said slide member having a pin receiving slot coacting with said pin whereby limited rotation of said knob causes displacement of said pin to frictionally engage said slide in said slot to cause limited sliding displacement of said slide between a locked and unlocked position, and arresting means to prevent movement of said slide by applying a force thereto when the slide is in its locked position, said arresting means being constituted by an abutment wall formed in an edge of said slot and an abutment face formed in said pin, said abutment wall and said abutment face being in flush contact with one another when said slide is located in said locked position with the central transverse long axis of said abutment face of said pin being aligned with said central axis of said rotating knob.

2. A lock mechanism as claimed in claim 1 wherein said slot extends transverse to the direction of movement of said slide member and to one side of said central axis of said circular body.

3. A lock mechanism as claimed in claim 2 wherein said slot has opposed edges and an open end extending into an elongated axial opening, said abutment wall being located in at least one of said opposed edges adjacent said opening, said pin frictionally engaging said edge having said notch when displacing said slide to said locked position and said other parallel edge to displace said slide to said unlocked position.

4. A lock mechanism as claimed in claim 3 wherein an abutment wall is provided in each said opposed edges and engaged flush with said abutment face when said rotating knob is displaced to its locked or unlocked position, respectively.

5. A lock mechanism as claimed in claim 1 wherein said rotating knob is provided with a cam having a peripheral edge in frictional contact with a pressure applying element to maintain said knob at a desired locked or unlocked position.

6. A lock mechanism as claimed in claim 5 wherein said peripheral edge is provided with two flat sections disposed 90° apart and displaceable to be engaged flush with a straight leaf spring which constitutes said pressure applying element.

7. A lock mechanism as claimed in claim 1 wherein said rotating knob is provided with position indicating means on an outside face thereof to visually display if said slide is in said locked or unlocked position.

8. A lock mechanism as claimed in claim 7 wherein said indicating means is a straight bar of distinguishing contrast extending across said rotating knob, said housing also having elongated aligned straight bar sections positioned to a respective side of said rotating knob, said straight bar on said rotating knob being aligned with said straight bar sections when said slide is in said locked position.

9. A lock mechanism as claimed in claim 1 wherein a stop pin is secured to said housing and protrudes through a slot in said slide to permit the sliding displacement thereof between said locked and unlocked position and preventing disengagement of said slide with said housing.

10. A lock mechanism as claimed in claim 1 wherein said locking element is a lock finger integrally formed with said slide and displaceable therewith to engage and disengage with a retaining wall formed in said keeper member.

11. A lock mechanism as claimed in claim 10 wherein a key-operated lock housing is secured to an opposite side of said closure member whereby said rotating knob can be rotated by a key inserted in said lock housing for displacing said slide to said locked or unlocked positions.

12. A lock mechanism as claimed in claim 1 wherein said closure member is a sliding door, said keeper member being secured to a door frame adjacent said housing.

13. A lock mechanism as claimed in claim 1 wherein said closure member is a window, said housing being secured to a window sash and said keeper member being secured to a window frame adjacent said housing.

* * * * *